US005987942A

United States Patent [19]

Ichinose

[11] Patent Number: 5,987,942

[45] Date of Patent: Nov. 23, 1999

[54] OUTER OPEN HANDLE ASSEMBLY FOR A VEHICLE DOOR

[75] Inventor: Mikio Ichinose, Yamanashi-ken, Japan

[73] Assignee: Mitsui Kinzoku Kogyo Kabushiki Kaisha, Tokyo, Japan

[21] Appl. No.: 08/880,862

[22] Filed: Jun. 23, 1997

[30] Foreign Application Priority Data

Jun. 26, 1996 [JP] Japan ..... 8-185445

[51] Int. Cl.[6] ..... F05B 13/10

[52] U.S. Cl. ..... 70/208; 292/336.3; 70/370; 70/451

[58] Field of Search ..... 292/336.3, 348, 292/354, DIG. 53; 70/208, 224, 370, 215, 451

[56] References Cited

U.S. PATENT DOCUMENTS

| | | | |
|---|---|---|---|
| 843,048 | 2/1907 | Voight | 292/348 |
| 4,412,696 | 11/1983 | Ishii et al. . | |
| 4,565,994 | 1/1986 | Mochia et al. . | |
| 4,892,342 | 1/1990 | Newman et al. | 292/336.3 |
| 5,297,405 | 3/1994 | Manning et al. | 70/370 |
| 5,377,450 | 1/1995 | Varajon | 292/336.3 |
| 5,410,899 | 5/1995 | McConnell | 70/370 |

FOREIGN PATENT DOCUMENTS

| | | | |
|---|---|---|---|
| 105678 | 8/1963 | Netherlands | 292/336.3 |
| 657584 | 9/1951 | United Kingdom | 70/370 |
| 1203008 | 8/1970 | United Kingdom | 292/336.3 |
| 1226372 | 3/1971 | United Kingdom | 70/336.3 |
| 2203790 | 10/1988 | United Kingdom | 70/370 |

*Primary Examiner*—Darnell M. Boucher
*Attorney, Agent, or Firm*—Browdy and Neimark

[57] ABSTRACT

An outer open handle assembly for a vehicle door comprises a handle base secured to a door outer panel by means of a first fastener, an outer opening handle rotatably attached to the handle base, a cylindrical attaching portion integrally formed with a rear surface of the handle base, a door key cylinder inserted into the attaching portion, and a U-shaped retainer having a first leg part, a second leg part, a U-shaped engaging part. The attaching portion has a first slit, and the key cylinder has a second slit. The handle base has a supporting portion to which a tip end of the first leg part is rotatably attached by a second fastener, and a boss part with which the first fastener is engaged. The engaging part is engaged with the first and second slits to secure the key cylinder to the attaching portion when the retainer is rotated about the second fastener as a center. A tip end of the second leg part is supported on the first and second slits.

3 Claims, 3 Drawing Sheets

OUTER OPEN HANDLE ASSEMBLY FOR A VEHICLE DOOR

FIELD OF THE INVENTION

The present invention relates to an outer open handle assembly for a vehicle door, and in particular, a handle assembly in which a door key cylinder has an enhanced attaching strength.

RELATED ART OF THE INVENTION

As disclosed in, for example, U.S. Pat. No. 4,412,696 or U.S. Pat. No. 4,565,994, a conventional door open handle assembly for a vehicle door is composed of a handle base secured to an outer panel of the door, an outer opening handle rotatably mounted on the handle base, and a door key cylinder secured to the handle base and coupled to a locking mechanism of the door by way of a rod. FIG. 1 shows a schematic view of a conventional handle base B and a conventional door key cylinder C. The handle base B which is secured to an outer panel A of a door is made of metal or synthetic resin, and is integrally incorporated thereto with a cylindrical attaching portion D in which the key cylinder C is inserted. The key cylinder C is secured at its rear end part with a key lever E which is in turn coupled thereto with a rod G linked to a locking mechanism F of the door so that the locking mechanism can be displaced between a locked position and an unlocked position when the key cylinder C is rotated by a corresponding door key H. The key cylinder C is secured to the attaching portion D by inserting a U-shaped pin L in a slit J formed in the portion D and a slit K formed in the key cylinder C.

The rear end part of the conventional key cylinder C can be moved, although the movement thereof is slight, by forcibly inserting a screw driver N or the like into a cylinder groove M formed in the key cylinder C and forcibly moving the driver N up and down. The movement of the rear end part causes the rod G to move up and down, and as a result, the locking mechanism would be changed over from the locked position into the unlocked position.

SUMMARY OF THE INVENTION

Accordingly, an object of the present invention is to provide an outer open handle assembly for a vehicle door, which can overcome the above-mentioned problems.

BRIEF DESCRIPTION OF THE DRAWINGS

The above and other objects, features and advantages of the present invention will become apparent from the detailed description of the preferred embodiment found below with reference to the accompanying drawings in which.

DESCRIPTION OF THE PREFERRED EMBODIMENTS

Figure 1:
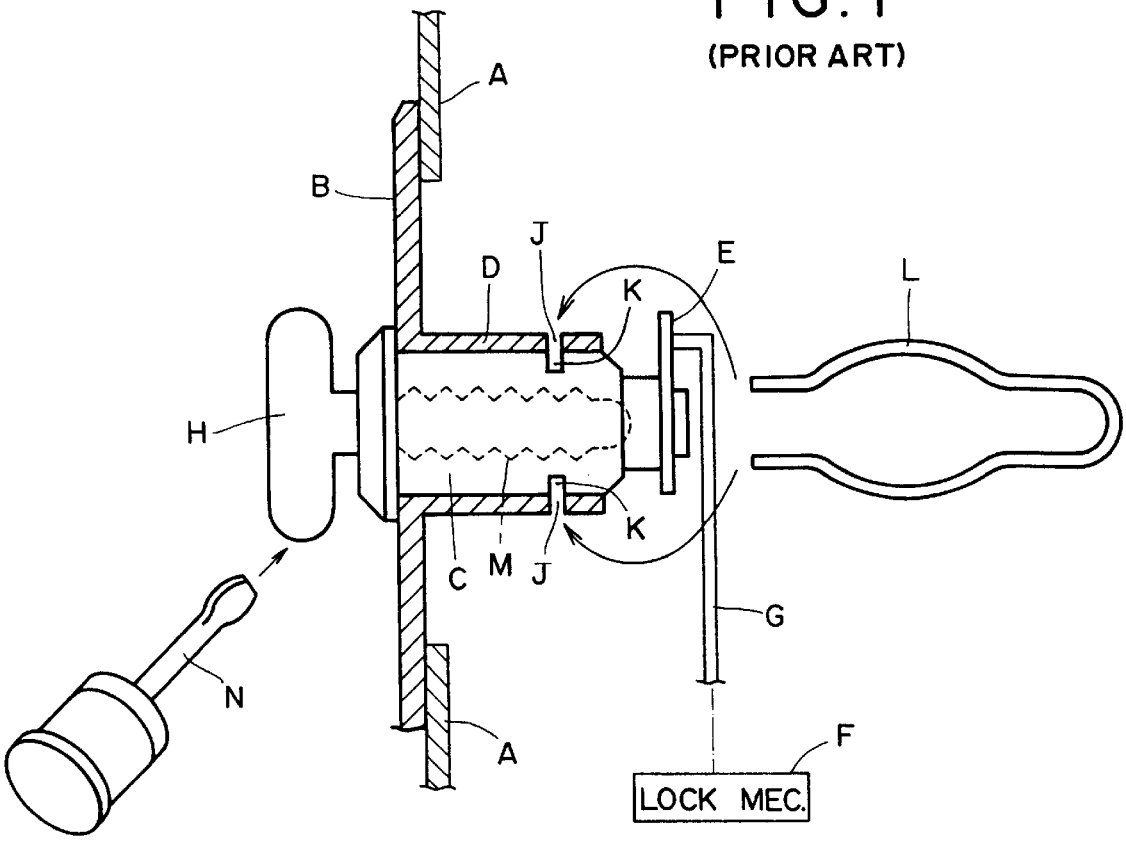
FIG. 1 (PRIOR ART)
FIG. 1 is a schematic view showing a conventional handle base and key cylinder.
Figure 3:
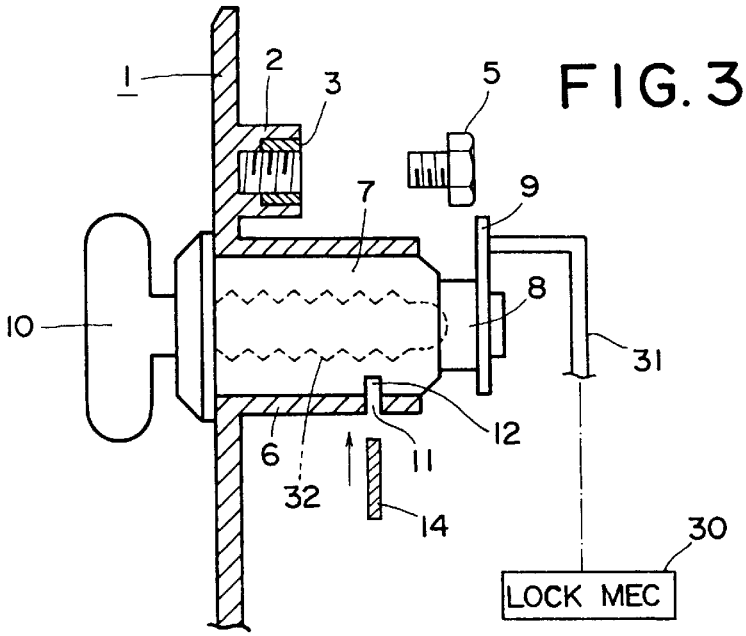
FIG. 3 is a sectional view showing an attaching portion of the handle base.
Figure 2:
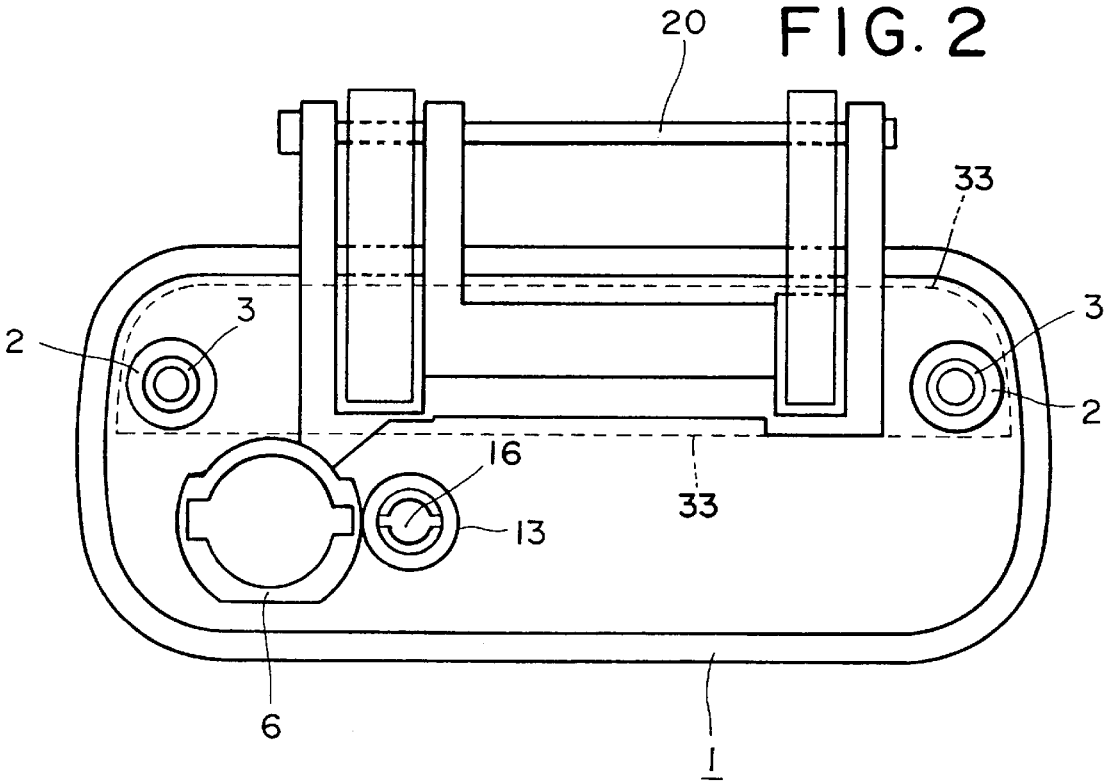
FIG. 2 is a rear view showing a handle base according to the present invention.
Figure 4:
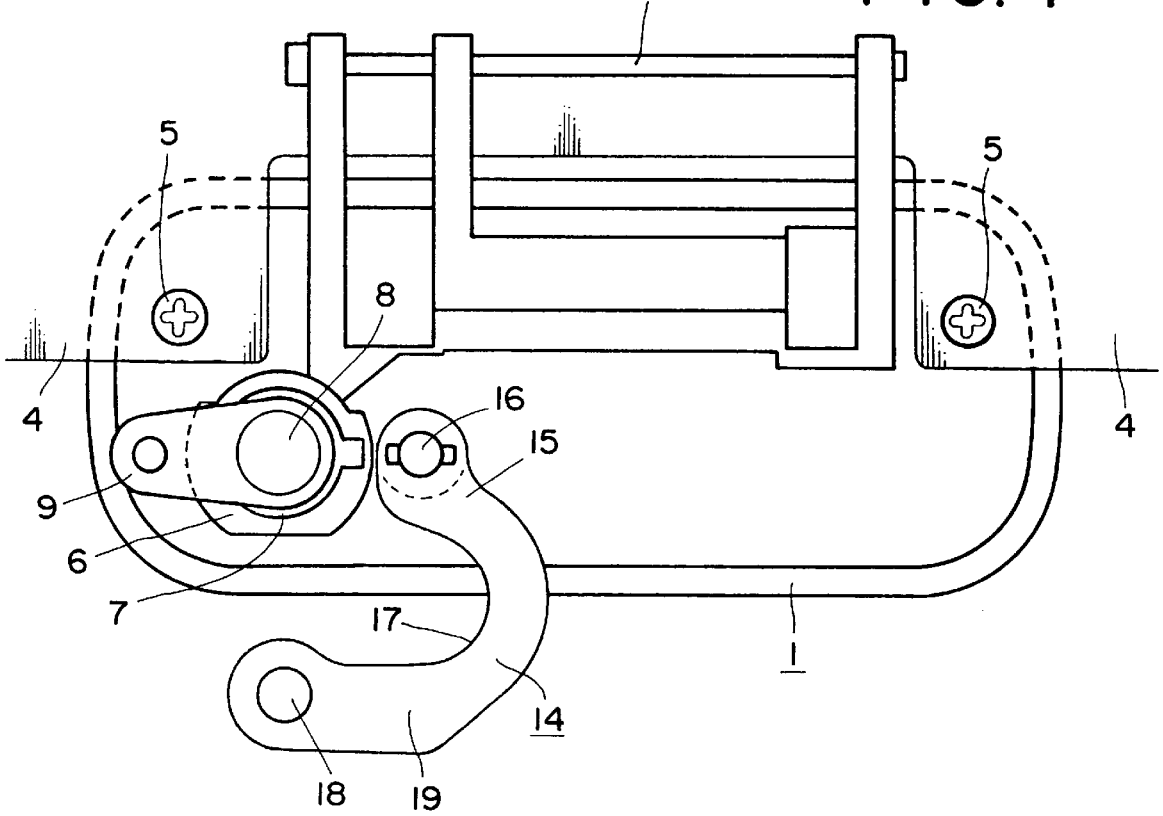
FIG. 4 is a rear view illustrating the handle base to which a key cylinder and a retainer are attached.
Figure 5:
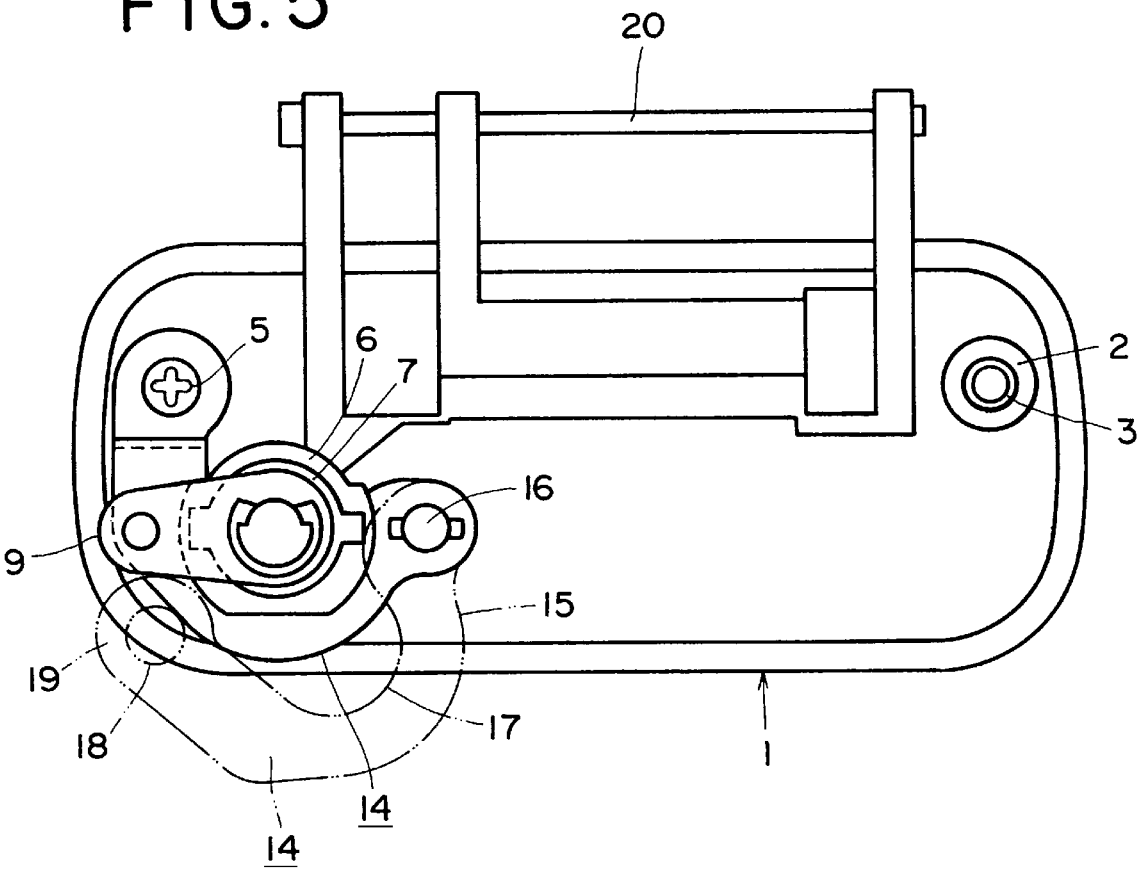
FIG. 5 is a rear view showing a condition in which the retainer is engaged with the key cylinder.
Figure 6:
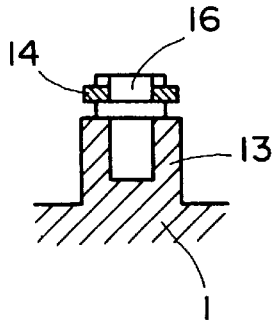
FIG. 6 is an enlarged sectional view illustrating a supporting portion of the handle base.

Referring to the drawings, an open handle assembly according to the present invention is composed of a handle base 1, and an outer opening handle 33 rotatably attached to the handle base 1 by using a shaft 20. The handle base 1 is formed by injection molding of die-cast metal or synthetic resin, similar to the conventional handle base, and is formed at its rear surface with a plurality of boss parts 2 which are adapted to be threadedly engaged with screws or bolts for fixing the handle base 1 to an outer panel 4 (FIG. 4) of a vehicle door. In a certain case, a metal nut 3 is embedded in each of the boss parts 2 as desired, by insert-molding.

The handle base 1 is integrally molded at its rear surface with a cylindrical attaching portion 6 in which a door key cylinder 7 is inserted. The attaching portion 6 is formed at a position near to one of the boss parts 2. A key lever 9 which is fixed to a rear end 8 of the key cylinder 7 projected rearward from the attaching portion 6 is coupled a locking mechanism 30 of the door by way of a rod 31. With this arrangement, when the key cylinder 7 is rotated by a corresponding door key 10, the locking mechanism 30 is displaced between a locked position and an unlocked position. In general, when the rod 31 is moved downward, the locking mechanism 30 is displaced to the unlocked position while when the rod 31 is moved upward, the locking mechanism 30 is moved to the locked position.

The handle base 1 is integrally molded at its rear side with a cylindrical supporting portion 13 which is located on one side of the attaching portion 6 so that the attaching portion 6 is sandwiched between the supporting portion 13 and the boss part 2 near to the attaching portion 6. A metal U-shaped retainer 14 for fixing the the key cylinder 7 to the attaching portion 6 has a first leg part 15, a second leg part 19, and a U-shaped engaging part 17 formed between the first and second legs. A tip end of the first leg part 15 is rotatably mounted on a T-head shaft 16 which is fixedly inserted to the supporting portion 13. Instead of the T-head shaft 16, a screw or a bolt may be used. A hole 18 is formed in the tip end of the second leg part 19.

The attaching portion 6 is formed therein with a slit 11 in a direction orthogonal to the center axis of the attaching portion 6, and a slit 12 corresponding to the slit 11 is formed in the key cylinder 7. When the retainer 14 is rotated about the shaft 16, the engaging part 17 of the retainer 14 is engaged in the slit 11 and the slit 12, thereby the key cylinder 7 is secured to the attaching portion 6. Further, when the U-like engaging part 17 is engaged in the slits 11 and 12, the hole 18 formed in the second leg part 19 is superposed with the corresponding boss part 2, the second leg part 19 is then fixed to the boss part 2 by means of the screw 5.

Thus, the key cylinder 6 inserted into the attaching portion 6 is supported underneath by means of the metal retainer 14 which is secured to the handle base 1, and accordingly, it is very difficult to move the rear end 8 of the key cylinder 7 downward for changing the locking mechanism 30 into the unlocked position by using a screw driver or the like.

Further, since the leg part 19 is secured to the boss part 2 by means of the screw 5 which is used for fixing the handle base 1 to the door panel 4, the retainer 14 can be surely attached, and the number of components can be reduced. It will be appreciated that, if desired, the remaining leg part 15 can be also fixed to the handle base 1 by using the screw 5.

It is noted that in the case of such a structure that the locking mechanism 30 is changed over into the unlocked position by moving the rod 31 upward, the key cylinder 7 should be protected at its upper side by the retainer 14.

The foregoing discussion discloses and describes merely exemplary embodiment of the present invention only. One skilled in the art will readily recognize from such discussion, and from the accompanying drawings and claims, that various changes, modifications and variations can be made therein without departing from the spirit and scope of the invention as defined in the following claims.

What is claimed is:

1. An outer open handle assembly in combination with a vehicle door, comprising:

a handle base secured to an outer panel of the vehicle door by means of a common fastener;

an outer opening handle rotatably attached to the handle base;

a cylindrical attaching portion integrally formed with a rear surface of the handle base, said attaching portion having a first slit extending in a direction orthogonal to the center axis of the attaching portion; said cylindrical attaching portion extending through an opening in the outer panel;

a door key cylinder inserted into the attaching portion and coupled to a locking mechanism of the vehicle door by way of a rod, said door key cylinder having a second slit corresponding to the first slit;

a U-shaped retainer having a first leg part, a second leg part, and a U-shaped engaging part formed between the first leg part and the second leg part, and engaging part being engageable with the first slit and the second slit;

a cylinder supporting portion integrally formed with the rear surface of the handle base which extends through the opening in the outer panel; and a T-head shaft having a shaft which is fixedly inserted into a shaft hole formed within the supporting portion, and a T-head part positioned at an outside of the supporting portion;

wherein said first leg part has an engaging hole which is rotatably engaged with the T-head part;

wherein said U-shaped engaging part is engaged with the first and second slits to secure the key cylinder to the attaching portion when the retainer is rotated about the T-head shaft as a center;

wherein said second leg part is secured to the rear surface of said handle base and the outer panel by said common fastener.

2. An outer open handle assembly according to claim 1, wherein said handle base is formed at the rear surface thereof with a boss part to be threadedly engaged with the common fastener, and said second leg part is secured to the outer panel and to said boss part by means of the common fastener.

3. An outer open handle assembly according to claim 2, wherein said second leg part has at a tip end a through hole into which the common first fastener is inserted, and said hole in the second leg part is superposed with the boss part when said through U-shaped engaging part is engaged over the first and second slits.

* * * * *